United States Patent [19]

Steinbach

[11] 4,078,405

[45] Mar. 14, 1978

[54] ALARM SWITCH MECHANISM FOR AN AXIAL SPLIT-PIN TUMBLER-TYPE LOCK

[75] Inventor: Robert L. Steinbach, Chicago, Ill.

[73] Assignee: Chicago Lock Co., Chicago, Ill.

[21] Appl. No.: 747,076

[22] Filed: Dec. 2, 1976

[51] Int. Cl.[2] ..... E05B 27/08

[52] U.S. Cl. ..... 70/363; 70/441; 70/DIG. 49

[58] Field of Search ..... 70/363, 364 A, 364 R, 70/431, 432, 434, 439, 441, DIG. 49

[56] References Cited

U.S. PATENT DOCUMENTS

| | | | |
|---|---|---|---|
| 3,813,906 | 6/1974 | Kerr | 70/363 |
| 3,878,700 | 4/1975 | Lopez | 70/363 |
| 3,986,376 | 10/1976 | Lack | 70/364 A |

*Primary Examiner*—Robert L. Wolfe
*Attorney, Agent, or Firm*—Norman H. Gerlach

[57] ABSTRACT

Alarm switch mechanism for an axial split-pin tumbler-type lock includes an electrical contact member disposed in the lock cylinder in the movement paths of lock tumbler elements and adapted for making an electrical contact with an element of any of the tumblers which is moved rearwardly or inwardly a predetermined distance, beyond the distance required for lock-opening purposes, means electrically insulating the contact member from the lock mechanism when no tumbler is in the latter position, and means adapted for making electrical connections to the tumbler elements and the contact member, respectively, whereby they may be connected in an alarm signal circuit closed by making said contact.

5 Claims, 14 Drawing Figures

ALARM SWITCH MECHANISM FOR AN AXIAL SPLIT-PIN TUMBLER-TYPE LOCK

BACKGROUND OF THE INVENTION

This invention relates to an alarm switch mechanism for an axial split-pin tumbler-type lock.

Locks of the axial split-pin tumbler type are picked by insertion of a picking tool, the tool being manipulated to cause the tumblers to bottom in the lock, after which the tumblers are allowed to move outwardly under the pressure of the tumbler springs, until the joints between tumbler elements or pins coincide with a transverse interfacial plane between a rotatable part and a stationary part of the lock, in which the tumbler elements are carried. With all of the tumblers so situated, the rotatable part is freed for rotation thereof and of a locking plate or other instrumentality carried thereby.

SUMMARY OF THE INVENTION

The present invention provides an alarm switch mechanism which is built into an axial split-pin tumbler-type lock and serves to produce an alarm signal when a picking attempt is made. The mechanism reacts to attempts to pick the lock by picks, wires, improper keys, and other instrumentalities. In particular, the mechanism serves to actuate a signal device at any time that a lock tumbler is bottomed in the lock, as occurs at the start of a picking operation.

The alarm switch mechanism may be employed in combination with a conventional axial split-pin tumbler-type lock, with but little alteration of the lock and with only a small increase in the length of the lock cylinder. The switch mechanism is constructed simply and economically, and of relatively few parts. The mechanism is adapted for use with any type of alarm signal device which may be actuated by an electrical impulse.

The invention in its broader aspects provides a combination of an axial split-pin tumbler-type lock mechanism and an alarm switch mechanism, wherein the lock mechanism includes a lock cylinder, a barrel assembly secured within the cylinder and having a longitudinal axis extending between front and rear ends thereof, the barrel assembly including a forwardly disposed operating part rotatable about the axis and a rearwardly disposed stationary part adjoining the operating part at a transverse interfacial plane, means forming longitudinal bores in the operating and stationary parts respectively, the bores in respective parts being movable into and out of alignment upon rotation of the operating part, tumblers having separate forwardly disposed driver elements and rearwardly disposed follower elements carried in the bores in adjoining relation when in aligned bores, at least the follower elements of the tumblers being electrically conductive, the tumblers being reciprocally movable in the axial direction in aligned bores between positions wherein the joint between the elements thereof is disposed on opposite sides of the interfacial plane, the operating part being freed for rotation when the joints coincide with the interfacial plane, and spring means yieldingly urging the tumblers in aligned bores forwardly to positions wherein the interfacial plane is bridged by the follower elements to secure the operating and stationary parts against relative rotation, the driver elements having front ends engageable with a key, whereby rearward movement of the key moves the tumblers in aligned bores rearwardly to positions wherein the joints coincide with the interfacial plane; and the switch mechanism includes an electrical contact member disposed in the lock cylinder in the movement paths of the follower elements and adapted for making an electrical contact with the follower element of any of the tumblers which is moved to a position wherein its joint is disposed a predetermined distance rearwardly of the interfacial plane, means electrically insulating the contact member from the lock mechanism when no tumbler is in the latter position, and means adapted for making electrical connections to the follower elements and the contact member, respectively, whereby they may be connected in an alarm signal circuit closed by making said contact.

BRIEF DESCRIPTION OF THE DRAWINGS

The attached drawings illustrate a preferred embodiment of the lock mechanism and switch mechanism combination of the invention, without limitation thereto. In the drawings, like elements are identified by like reference symbols in each of the views, and.

DESCRIPTION OF THE PREFERRED EMBODIMENT

Figure 1:
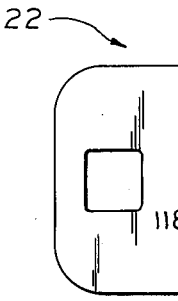
FIG. 1 is a side elevational view of a key which cooperates with the lock of FIG. 2.
Figure 2:
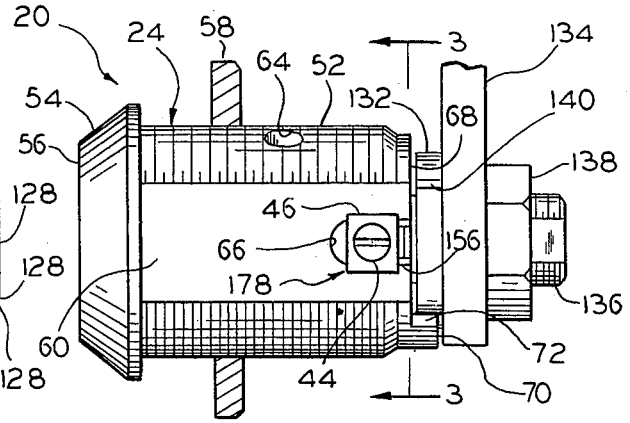
FIG. 2 is a side elevational view of an axial split-pin tumbler-type lock and a switch mechanism employed in combination therewith, in accordance with the invention.
Figure 3:
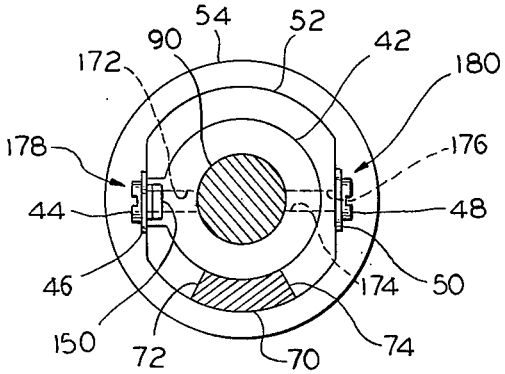
FIG. 3 is a transverse sectional view of the combination of FIG. 2, taken substantially on line 3—3 thereof.
Figure 4:
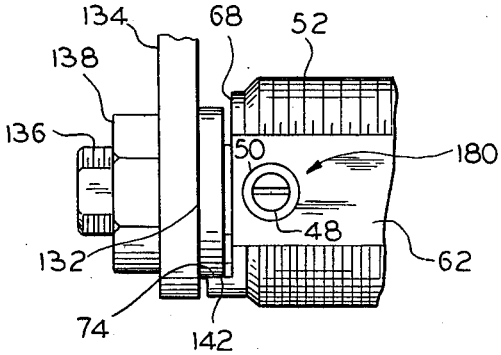
FIG. 4 is a fragmentary side elevational view of the opposite side of the combination of FIG. 2.

Referring to the drawings, particularly FIGS. 1 and 2, an axial split-pin tumbler-type lock generally indicated by the number 20 is employed with a key 22. The lock 20 and the key 22 are basically conventional structures, with the lock 20 being altered for cooperation with switch mechanism, as described hereinafter. The illustrative lock 20 and key 22 are constructed and operated essentially in the same manner as the lock and key illustrated in U.S. Pat. No. 3,102,412. The specific lock structure selected for illustration herein is commonly identified as a "cam lock". The invention is not limited to such structures, but it includes other lock structures, such as the "switch lock" illustrated in U.S. Pat. No. 3,813,906.

Figure 5:
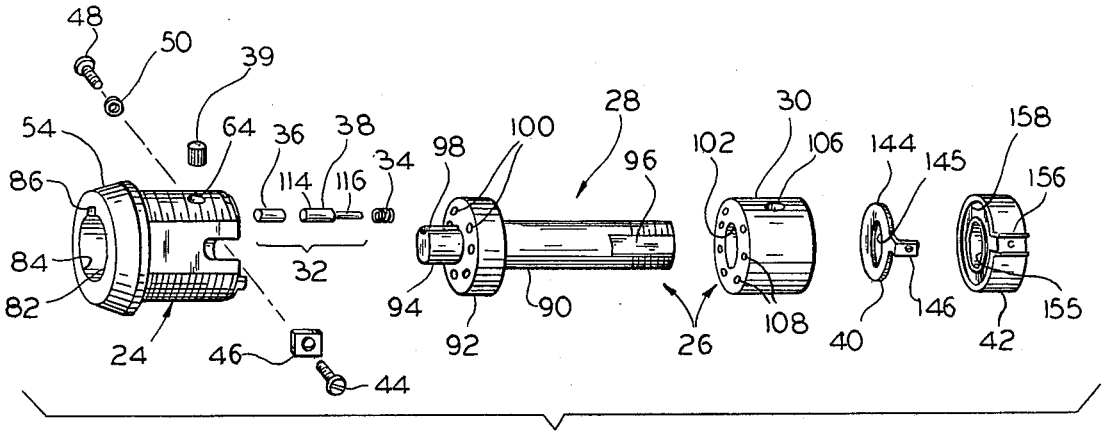
FIG. 5 is an exploded perspective view of the combination of FIG. 2, on a reduced scale.

Referring to FIG. 5, the lock 20 includes a lock cylinder 24 and a barrel assembly 26. The barrel assembly 26 includes a rotatable operating part or plug assembly 28 and a stationary part or sleeve member 30. The lock also includes a plurality of tumblers 32, which are seven in number, and a like number of tumbler springs 34. Each tumbler is composed of a driver element or pin 36 and a follower or locking element or pin 38. The lock further includes a mounting pin 39.

A switch mechanism includes an electrical contact member 40, an electrical insulator 42, a first electrically conductive contact screw 44, an electrically insulating washer 46, a second electrically conductive contact screw 48, and an electrically conductive washer 50.

Referring to FIGS. 2–6, the lock cylinder 24 includes an elongated tubular body 52 and an enlarged frustoconical head 54 on the body at the front or outer end 56 of the clock. The lock cylinder body 52 is externally threaded for engagement with a mounting nut 58 (shown only in this view), in a conventional manner. Flats 60 and 62 are provided on opposite sides of the body 52. The illustrative lock 20 is designed for mounting in an opening in a cabinet wall or door, not shown, and the surrounding wall panel or the like is clamped between the cylinder head 54 and the nut 58, to secure the lock in place. The opening has the same contour as the cylinder body 52, oblong by virtue of the flats 60 and 62, so that the lock cylinder 24 is prevented from rotating in its mounting.

The cylinder body 52 is provided with a hole 64 extending transversely therein and serving to receive the mounting pin 39. The cylinder body 52 also is provided with a rectangular access slot 66 located in one of the flats 60 and extending forwardly from the rear or inner end 68 of the body. An arcuate longitudinal extension 70 is integral with the rear end 68 of the cylinder body 52, and shoulders 72 and 74 (FIG. 3) are formed by the opposite side edges thereof.

Figure 6:
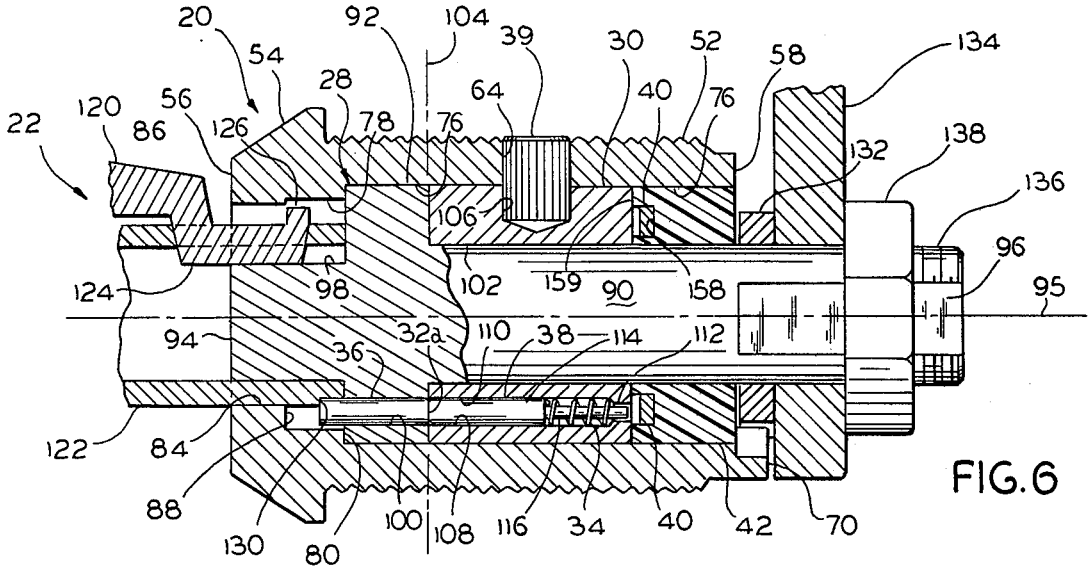
FIG. 6 is a longitudinal sectional view of the combination of FIG. 2, enlarged with respect thereto, and of a portion of the key of FIG. 1, shown in engagement with the lock to place it in an unlocked condition.

Referring to FIG. 6, the cylinder body 52 is provided with a longitudinal cylindrical bore 76. A second longitudinal cylindrical bore 78 of reduced diameter is provided in the front end of the cylinder body 52 and in the adjoining portion of the head 54. An annular barrel-retention shoulder or ledge 80 is formed at the junction of the bores 76 and 78.

Referring to FIGS. 5–8, the cylinder head 54 includes an annular closure flange 82 which extends radially inwardly from the wall of the reduced diameter bore 78 and which defines a key opening 84. A key guide notch 86 extends radially outwardly from the inner edge of the closure flange 82. The closure flange 82 provides a tumbler-retention shoulder or ledge 88.

The operating part 28 includes a substantially cylindrical lock shaft 90, a cylindrical head 92 integral with the front end of the lock shaft and having a greater diameter than the shaft, and a generally cylindrical guide post 94 integral with the front end of the head 92 and having a smaller diameter than the shaft 90. The several components of the operating part 28 have axes which coincide with a longitudinal axis 95 (FIG. 6) of the part, which axis is also the longitudinal axis of the complete barrel assembly 26 and the stationary part 30 thereof when the parts are assembled. While the illustrative operating part 28 is constructed integrally of the several components, any of the components may be separately constructed and secured to the remaining components by suitable means. In particular, it is advantageous frequently to construct the guide post 94 separately of harder material.

The lock shaft 90 is provided with a pair of diametrically opposed flats 96 at the rear end of the shaft. The guide post 94 is provided with a longitudinal drive notch 98. Longitudinal cylindrical tumbler bores 100 of equal diameter extend through the operating part head 92, and they are disposed radially outwardly of the lock shaft 90 at equal radii from the axis 95. The bores are spaced apart around the axis 95 at equal angles of 45 degrees, except for two bores which are spaced apart at an angle of 90 degrees.

The operating part 28 is received in the lock cylinder 24 with the front face of the head 92 abutting on the barrel-retention shoulder 80 and with the guide post 94 centrally disposed in the key opening 84 and spaced from the closure flange 82 therearound. The guide post 94 terminates at its front end approximately at the plane of the face of the flange 82. The operating part 28 is rotatable in the lock cylinder 24 about the axis 95.

The stationary part 30 is a cylindrical tubular member having a bore 102 which journals the lock shaft 90, and a front face which adjoins the rear face of the operating part head 92 at a transverse interfacial plane 104. A pin-receiving hole 106 is provided in the wall of the stationary part 30. The stationary part 30 is secured in the lock cylinder 24, thereby securing the barrel assembly 26 therein, by means of the mounting pin 39, which is force-fitted into the aligned pin-receiving holes 64 and 106 in the cylinder body 52 and the stationary part, respectively.

Longitudinal tumbler bores 108 are provided in the stationary part 30 at angles of 45 degrees therearound, except for two bores which are spaced apart at an angle of 90 degrees. Each of the stationary part tumbler bores 108 includes a front cylindrical portion 110 and a rear reduced diameter cylindrical stem-receiving portion 112. The front portions 110 have the same diameter as the diameter of the tumbler bores 100 in the operating part 92. The stationary part tumbler bores 108 are disposed radially outwardly of the lock shaft 90 at the same radius from the axis 95 as for the operating part tumbler bores 100. Accordingly, the tumbler bores 100 and 108 in the respective parts are movable into and out of alignment upon rotation of the operating part 28.

The driver elements 36 are substantially cylindrical pins having a diameter slightly smaller than the diameter of the tumbler bores 100 and 108. The follower elements 38 are constructed integrally of a substantially cylindrical body portion 114 having the same diameter as the driver elements 36, and a substantially cylindrical coaxial stem portion 116 of reduced diameter extending rearwardly from the body.

Each tumbler 32 is reciprocally movable in the axial direction in aligned tumbler bores 100 and 108. The tumblers are movable between an outermost position, illustrated in FIG. 7, where the joint **32*a* between the tumbler elements 36 and 38 is disposed forwardly of the interfacial plane 104, and an innermost position, illustrated in FIG. 8, wherein the joint 32*a* is disposed on the opposite side or rearwardly of the interfacial plane 104**.

The operating part 28 is freed for rotation when the joints 32*a* between the several tumblers 32 all coincide with the interfacial plane 104.

Figure 8:
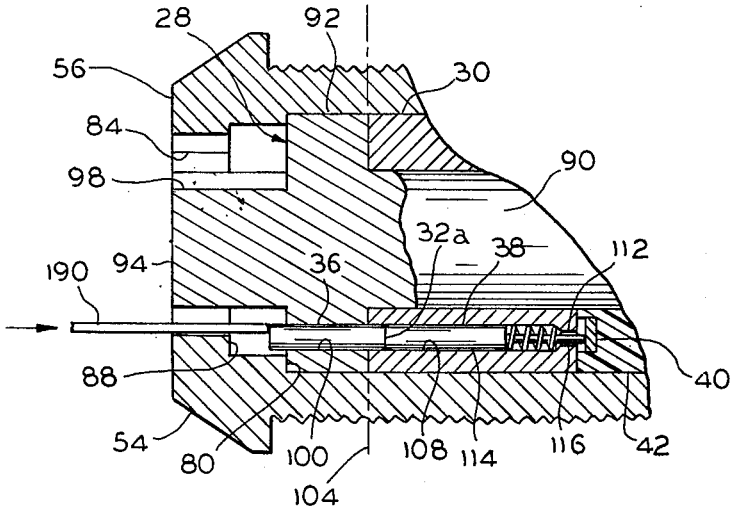
FIG. 8 is a fragmentary longitudinal sectional view similar to FIG. 7, but illustrating the condition of the lock when a picking attempt is made.

The stem portions 116 of the follower elements 38 extend through the reduced diameter stem-receiving portions 112 of the stationary part tumbler bores 108 when the tumbler joint 32*a* is to the rear of the plane 104, as illustrated in FIG. 8. The stem portions 116 also extend rearwardly beyond the stationary part 30 when the tumbler joints 32*a* are disposed a predetermined distance rearwardly of the interfacial plane 104, for cooperation with components of the switch mechanism, as described hereinafter.

Figure 7:
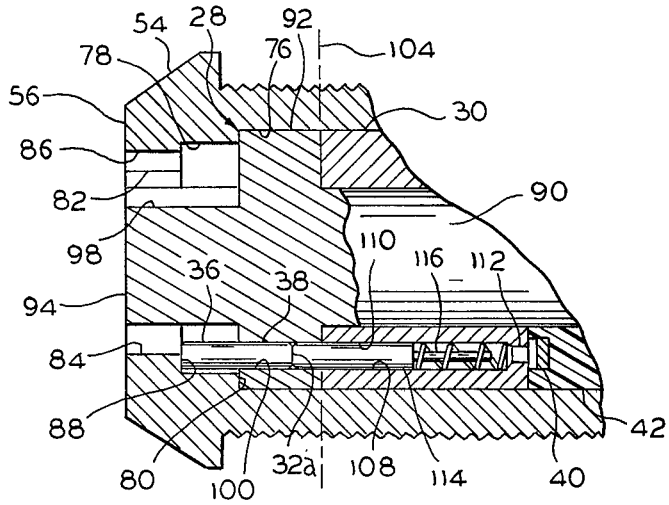
FIG. 7 is a fragmentary longitudinal sectional view similar to FIG. 6, but with the key removed, illustrating the lock as it appears in its locked condition.

The tumbler springs 34 are helical coil compression springs, and one of the springs is mounted around the stem portion 116 of each follower element 38, in the front portion 110 of the stationary part tumbler bore 108 in which the follower element is received. The spring 34 is seated at the rear end of the front portion 110 of the tumbler bore 108, adjacent to the stem-receiving bore portion 112. The spring yieldingly urges the tumbler 32 in aligned tumbler bores 100 and 108 forwardly to a position wherein the interfacial plane 104 is bridged by the body portion 114 of the follower element 38, as illustrated in FIG. 7, to secure the operating part 28 and the stationary part 30 against relative rotation.

Referring to FIGS. 1 and 6, the key 22 includes a body 118 to which is connected a wing-type torque-applying or manipulating handle 120. The body 18 includes a cylindrical tubular shank portion 122. The handle 120 terminates at an integral longitudinally extending drive lug 124, which extends through a corresponding slot in the shank portion 122. A guide lug 126 is integral with the outer end of the drive lug 124, and extends radially outwardly therefrom and beyond the outer surface of the shank portion 122. Grooves 128 are formed in the outer surface of the shank portion 122, and they extend longitudinally from the outer end of the shank portion. The grooves 128 terminate in bittings or shoulders 130. The grooves 128 and the corresponding bittings 130 each are seven in number, and they are spaced apart at angles of 45°, except for two grooves and their bittings, which are spaced apart at an angle of 90°.

The key 22 is inserted in the lock 20 by inserting the shank portion 122 in the key opening 84 and around the guide post 94. The guide lug 126 on the key is inserted in the guide notch 86 in the lock flange 82, and the drive lug 124 is inserted in the drive notch 98 in the guide post 94. The driver elements 36 of the tumblers 32 in part are received in the key grooves 128, and the front ends of the driver elements abuttingly engage the key bittings 130. Rearward movement of the key 22 moves the tumblers 32 in aligned tumbler bores 100 and 108 rearwardly, until the shank portion 122 of the key bottoms on the head 92 of the operating part 28, as illustrated in FIG. 6. At this time, the tumbler joints 32*a* coincide with the interfacial plane 104, and the guide lug 126 on the key is disposed rearwardly of the closure flange 82, so that the operating part 28 may be rotated by rotation of the key, to thereby operate the lock.

In the illustrative embodiment of a "cam lock", a stop disc 132 and a locking plate or arm 134 are mounted on the rear end of the lock shaft 90 for rotation therewith. Thus, the shaft portion having the flats 96 extends through similarly shaped oblong openings in the stop disc 132 and the locking plate 134. The lock shaft 90 has a screw-threaded rear end 136, and a nut 138 is in threaded engagement therewith, for securing the stop disc 132 and the locking plate 134 on the shaft 90.

The stop disc 132 is a conventional member. It is provided with two shoulders 140 and 142 (FIGS. 2 and 4) which alternately abut on the respective extension shoulders 72 and 74 upon rotation of the lock shaft 90 in opposite directions through an angle of 90°. The locking plate 134 thus may be rotated 90° in opposite directions, from a locking position in which the locking plate engages a panel or other member, to an unlocking position in which the locking plate is clear of such member.

Figure 9:
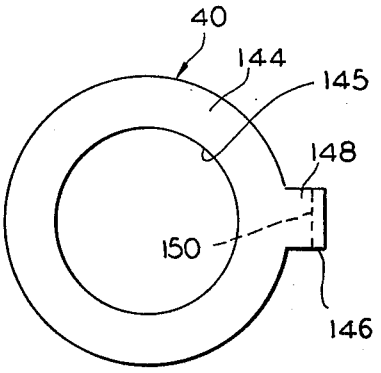
FIGS. 9 and 10 are front and side elevational views, respectively, of a contact member employed in the switch mechanism shown in the preceding views, illustrated on a further enlarged scale.
Figure 10:
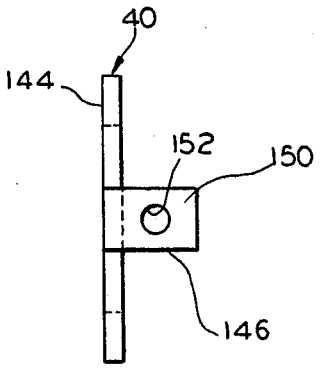

Referring particularly to FIGS. 9 and 10, the contact member 40 is constructed of electrically conductive material, such as bronze or brass metal. The contact member 40 includes a relatively thin flat circular ring element 144 of rectangular cross section, having a central circular opening 145 extending therethrough. The contact member 40 also includes a lead-in element 146 in the form of a bent strip integral with the ring element 144 and having the same cross section. The lead-in element includes a radially outwardly projecting rectangular connecting portion 148 and a rectangular tab portion 150 integral with the outer end of the projecting portion and extending perpendicularly to the plane of the ring element and the projecting portion. A screw-receiving hole 152 extends through the tab portion 150. A screw may be self-tapped in the hole 152, or a screw thread may be provided in the hole, for making electrical contact between the tab portion 150 and a screw inserted in the hole.

Figure 11:
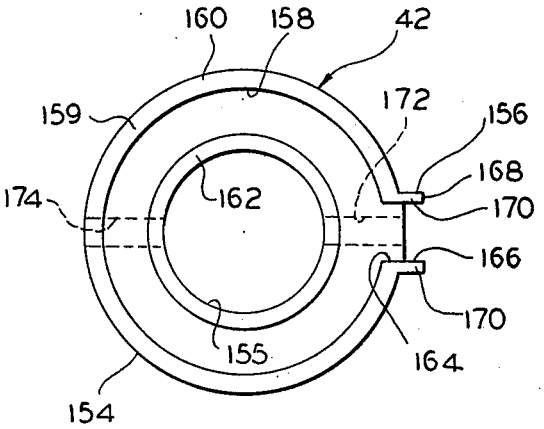
FIGS. 11 and 12 are front and side elevational views, respectively, of an insulator employed in the switch mechanism, illustrated on the same scale as FIGS. 9 and 10.
Figure 12:
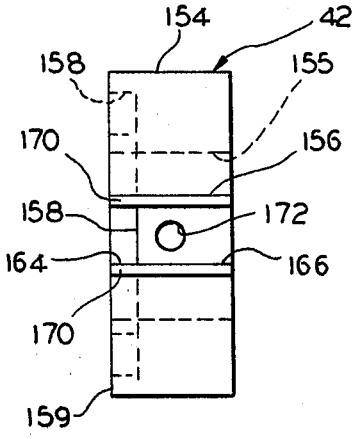
Figure 13:
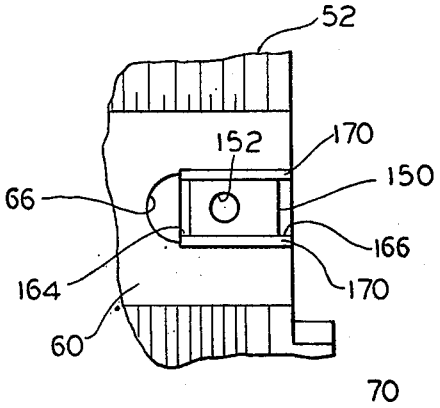
FIG. 13 is an enlarged fragmentary side elevational view of a portion of the combination illustrated in FIG. 2, with a screw and a washer removed to reveal the arrangement of the parts therebeneath.

Referring particularly to FIGS. 11 and 12, the insulator 42 is constructed of insulating or non-conductive material, such as nylon or other synthetic plastic material. The insulator 42 includes a circular ring element 154 having a central circular opening 155 extending axially therethrough, and an integral rectangular boss 156 extending radially from the side of the ring element. The insulator ring element 154 is provided with a circular channel-like recess 158 of rectangular cross section, formed in one side surface 159 of the ring element. The recess 158 is bordered by a C-shaped outer wall 160 and a circular inner wall 162. A rectangular opening 164 having the same depth as the recess 158 is provided in the outer wall 160, in alignment with the boss 156.

A laterally facing rectangular channel-like recess 166 of rectangular cross section is formed in the outer surface 168 of the boss 156. The recess 166 is bordered by two spaced apart parallel walls 170. The recess 166 in the boss 156 communicates with the recess 158 in the insulator ring element 154 through the opening 164 in the outer wall 160 of the ring element. A screw-threaded hole 172 extends radially through the insulator ring element 154 to the recess 166 in the boss 156, and a like screw-threaded hole 174 extends in diametrically opposed relation through the opposite side of the ring element 154.

Referring to FIGS. 2, 3, 5, 6 and 9-12, the contact member 40 is seated on the insulator 42 with the contact member ring element 144 received in the recess 158 in the insulator ring element 154 and the contact member tab portion 150 received in the recess 166 in the boss 156, while the connecting portion 148 extends through the wall opening 164. The edges of the contact member ring element 144 are bounded by the outer and inner walls 160 and 162 of the insulator ring element 154, with the inner wall 162 received within the opening 145 in the contact member ring element. The recesses 158 and 166 in the insulator 42 are deeper than the thickness of the contact member 40 and the individual ring and lead-in elements 144 and 146 thereof, so that the contact member 40 is spaced from the adjacent side surface 159 on the ring element 154 and the outer surface 168 of the boss.

The insulator 42 is mounted on the lock shaft 90 and within the lock cylinder body 52, with the shaft inserted through the opening 155 in the insulator. The insulator 42 is mounted adjacent to the stationary part 30, with the recessed side surface 159 of the insulator in contact with the rear surface of the stationary part. The lock cylinder body 52 and the lock shaft 90 are constructed in lengths sufficient to accommodate the thickness of insulator 42, which is additional to the conventional lock structure. The boss 156 registers with and extends through the access slot 66 in the cylinder body 52. The width of the boss 156 is substantially the same as the width of the access slot 66, so that the insulator 42 is prevented from rotating in the cylinder body 52.

With the contact member 40 seated on the insulator 42, in the manner described above, so that the tab portion 150 is seated in the recess 166 in the boss 156, the tab portion is exposed through the access slot 66. The first contact screw 44 is inserted through the hole in the insulating washer 46, through the hole 152 in the tab portion 150, in threaded engagement with the tab portion, and into the adjacent screw hole 172 in the insulator ring element 154, in threaded engagement therewith. The first contact screw 44 thus secures the contact member 40 in its seated position, and makes electrical contact with the contact member 40 by engagement with the tab portion 150. Owing to the above-described spacing of the contact member 40 from the outer surfaces of the insulator 42, the contact member is spaced from adjacent components of the lock mechanism and is insulated from the lock mechanism when no tumbler element is in contact therewith. At the same time, the ring element 144 of the contact member 40 faces the stemreceiving portions 112 of the stationary part bores 108 in alignment therewith, for making an electrical contact with the stem portion 116 of the follower element 38 of any of the tumblers 32 which is moved rearwardly to a predetermined extent.

Referring to FIGS. 3–5 and 11, the second electrical contact screw 48 is inserted through the hole in the conductive washer 50, through a hole 176 (FIG. 3) in the flat 62 on the cylinder body 52, and into threaded engagement in the screw hole 174 in the insulator 42. The second screw 48 and the conductive washer 50 are in electrically conductive relation to the cylinder body 52. The lock 20 in the illustrative embodiment is constructed entirely of conductive metal. Accordingly, the second screw 48 is in conductive relation to the follower elements 38.

Referring to FIGS. 2–5 and 14, the first contact screw 44 and the insulating washer 46 secured thereby form a first electrical terminal 178 which is electrically connected to the contact member 40. The second contact screw 48 and the conductive washer 50 secured thereby form a second electrical terminal 180 which is electrically connected to the tumblers 32, particularly the follower elements 38 thereof. An external electrical conductor or lead may be secured between the first contact screw 44 and the adjacent insulating washer 46, in contact with the screw, to make an electrical connection to the contact member 40. The insulating washer 46 in the illustrative embodiment is a flat square member formed of nonconductive fiber material, and it serves to prevent the external conductor from making electrical contact with the cylinder body 52. An external ground conductor or lead may be connected between the ground screw 48 and its adjacent circular conductive washer 50, to make an electrical connection to the tumblers 32.

Figure 14:
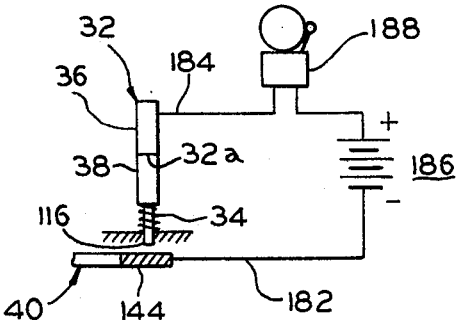
FIG. 14 is a diagram schematically illustrating the connection of a lock tumbler and of the contact member in an electrical circuit incorporating a device for signaling an attempt to pick the lock.

As schematically illustrated in FIG. 14, conductors 182 and 184 connected in the foregoing ways to the contact member 40 and the tumblers 32, respectively, may be connected to an electrical battery 186 or other electrical power source and to an alarm bell 188 or other appropriate alarm signal device. When the circuit is closed by contact between the contact member 40 and the stem portion 116 of one of the follower elements 38, the alarm bell 188 is actuated.

While in the illustrative embodiment, the second terminal 180 is provided for attachment of a ground conductor, it will be apparent that the ground conductor may be electrically connected to the lock 20 in various ways. Thus, for example, the ground conductor may be secured between the lock cylinder head 54 and the mounting nut 58 when the lock is mounted on a panel or the like. It will be apparent also that various signal devices may be employed in place of the alarm bell 188. The signal device may be wired in circuit with a relay, if desired, to produce a constant alarm signal once contact between a stem portion 116 and the contact member 40 has been made.

When the lock 20 is in the locked condition illustrated in FIG. 7, and when the lock is in the unlocked condition illustrated in FIG. 6, which results from insertion of a proper key 22, the stem portions 116 of the follower elements 38 are spaced from the contact member 40, and the circuit to the alarm signal device is open, as illustrated in FIG. 14. The lock components are dimensioned such that when any of the tumblers 32 is moved to move its joint **32*a* a predetermined distance rearwardly of the interfacial plane 104, the stem portion 116 thereof extends through the stem-receiving portion 112 of the tumbler bore 108 and rearwardly beyond the stationary part 30, into contact with the contact member 40, particularly the ring element 144 thereof, to actuate the alarm bell 188 and thereby sound an alarm. This condition of the lock is illustrated in FIG. 8, where a wire-like picking member 190, illustrated fragmentarily, is illustrated as having moved the tumbler 32 rearwardly. The same result would be obtained and an alarm would be given if an improper key were used, i.e., a key having a bitting which moves one of the tumblers 32 rearwardly until its stem portion 116 makes contact with the contact member 40**.

The switch mechanism thus is readily incorporated in an otherwise generally conventional axial split-pin tumbler-type lock, with relatively little additional material, cost and space requirements. The provision of the alarm system is not detectable from the front of the lock, and an alarm is given at the start of a picking operation, when the first tumbler is bottomed initially and before a successful attempt to locate the tumbler joints **32*a* at the interfacial plane 104** can be made.

While a preferred embodiment of the invention has been illustrated and described, and reference has been made to certain changes and modifications which may be made in the embodiment, it will be apparent that further changes and modifications may be made therein within the spirit and scope of the invention. It is intended that all such changes and modifications be included within the scope of the appended claims.

Having thus described the invention, what I claim as new and desire to secure by Letters Patent is:

1. In combination with an axial split-pin tumbler-type lock mechanism including a lock cylinder, a barrel assembly secured within said cylinder and having a longitudinal axis extending between front and rear ends thereof, said barrel assembly including a forwardly disposed operating part rotatable about said axis and a rearwardly disposed stationary part adjoining the operating part at a transverse interfacial plane, said operating part including an axial lock shaft extending rearwardly in said cylinder and said stationary part comprising a sleeve member journalling said shaft, means forming longitudinal bores in said operating and stationary parts, respectively, and disposed radially outwardly of said shaft therearound at equal radii from said axis, said bores in respective parts being movable into and out of alignment upon rotation of said operating part, tumblers each having a forwardly disposed driver element carried in one of said operating part bores and a separate rearwardly disposed follower element carried in one of said stationary part bores and the elements adjoining each other when in aligned bores, at least the follower elements of said tumblers being electrically conductive, said tumblers each being reciprocally movable in the axial direction in aligned bores between positions wherein the joint between said elements thereof is disposed on opposite sides of said interfacial plane, said operating part being freed for rotation when said joints coincide with interfacial plane, and spring means yieldingly urging said tumblers in aligned bores forwardly to positions wherein said interfacial plane is bridged by said follower elements to secure the operating and stationary parts against relative rotation, said driver elements having front ends engageable with a key, whereby rearward movement of the key moves said tumblers in aligned bores rearwardly to positions wherein said joints coincide with said interfacial plane, an alarm switch mechanism which comprises:

an insulator including a ring element of insulating material surrounding said shaft adjacent to said stationary part and having an annular channel-like recess in the surface thereof facing the stationary part, said recess being aligned with said stationary part bores, an electrical contact member including a ring element of conductive material disposed in said recess in the movement paths of said follower elements and seated on the insulator in spaced relation to the mouth of the recess and thereby also to said stationary part, said contact member ring element thereby being insulated from said lock mechanism while being adapted for making an electrical contact with the follower element of any of said tumblers which is moved to a position wherein its joint is disposed a predetermined distance rearwardly of said interfacial plane, and means adapted for making electrical connections to said contact member and said follower elements, respectively, whereby they may be connected in an alarm signal circuit closed by making said contact.

2. In combination with an axial split-pin tumbler-type lock mechanism including a lock cylinder having a tubular body provided with an access slot therethrough, a barrel assembly secured within said cylinder and having a longitudinal axis extending between front and rear ends thereof, said barrel assembly including a forwardly disposed operating part rotatable about said axis and a rearwardly disposed stationary part adjoining the operating part at a transverse interfacial plane, said operating part including an axial lock shaft extending rearwardly in said cylinder and said stationary part comprising a sleeve member journalling said shaft, means forming longitudinal bores in said operating and stationary parts, respectively, and disposed radially outwardly of said shaft therearound at equal radii from said axis, said bores in respective parts being movable into and out of alignment upon rotation of said operating part, tumblers each having a forwardly disposed driver element carried in one of said operating part bores and a separate rearwardly disposed follower element carried in one of said stationary part bores and the elements adjoining each other when in aligned bores, at least the follower elements of said tumblers being electrically conductive, said tumblers each being reciprocally movable in the axial direction in aligned bores between positions wherein the joint between said elements thereof is disposed on opposite sides of said interfacial plane, said operating part being freed for rotation when said joints coincide with said interfacial plane, and spring means yieldingly urging said tumblers in aligned bores forwardly to positions wherein said interfacial plane is bridged by said follower elements to secure the operating and stationary parts against relative rotation, said driver elements having front ends engageable with a key, whereby rearward movement of the key moves said tumblers in aligned bores rearwardly to positions wherein said joints coincide with said interfacial plane, an alarm switch mechanism which comprises:

an insulator including a ring element of insulating material surrounding said shaft adjacent to said stationary part and a boss on the side of the ring element and registering with said access slot, said insulator ring element having an annular channel-like recess in the surface thereof facing said stationary part and the recess being aligned with said stationary part bores, said boss having a channel-like recess in the outer surface thereof, an electrical contact member including electrically interconnected ring and lead-in elements of conductive material, said contact member ring element being disposed in said recess in the insulator ring element in the movement paths of said follower elements and seated on the insulator in spaced relation to the mouth of the latter recess and thereby also to said stationary part, said lead-in element being seated on said boss in said recess thereof, said contact member elements thereby being insulated from said lock mechanism while the contact member ring element is adapted for making an electrical contact with the follower element of any of said tumblers which is moved to a position wherein its joint is disposed a predetermined distance rearwardly of said interfacial plane, and means adapted for making electrical connections to said lead-in element and said follower elements, respectively, whereby they may be connected in an alarm signal circuit closed by making said contact.

3. A combination as defined in claim 2 and wherein said means adapted for making an electrical connection to said lead-in element includes a screw associated therewith.

4. In combination, an axial split-pin tumbler-type lock mechanism and an alarm switch mechanism, said lock mechanism comprising:

a lock cylinder including a tubular body provided with an access slot therethrough at a rear end thereof, a barrel assembly secured within said cylinder and having a longitudinal axis extending between front and rear ends thereof, said barrel assembly including a forwardly disposed operating part rotatable about said axis and a rearwardly disposed stationary part, said operating part including a cylindrical head and an axial lock shaft of reduced diameter extending rearwardly from said head, said stationary part comprising a sleeve member journalling said shaft and adjoining said head at a transverse interfacial plane, means forming longitudinal cylindrical bores in said head and said stationary part, respectively, and disposed radially outwardly of said shaft therearound at equal radii from said axis, said bores in respective parts being movable into and out of alignment upon rotation of said operating part, said stationary part bores including front portions having the same diameter as said head bores and rear portions of reduced diameter, tumblers each having elements of circular cross section including a forwardly disposed driver element carried in one of said head bores and a separate rearwardly disposed follower element carried in one of said stationary part bores and the elements adjoining each other when in aligned bores, at least the follower elements of said tumblers being electrically conductive, said follower elements each including a front portion having an outer diameter substantially the same as the diameter of said driver elements and greater than the diameter of said rear portions of the stationary part bores, each of said follower elements also including a rear stem portion of reduced diameter reciprocatable in the rear portion of the stationary part bore in which the follower element is carried, said tumblers each being reciprocally movable in the axial direction in aligned bores between positions wherein the joint between said elements thereof is disposed on opposite sides of said interfacial plane, said operating part being freed for rotation when said joints coincide with said interfacial plane, said stem portion of each follower element being adapted to extend through the rear portion of the stationary part bore in which the follower element is carried and rearwardly beyond the stationary part when the joint of the tumbler which includes the follower element is disposed a predetermined distance rearwardly of said interfacial plane, and coil compression springs mounted around said stems in said front portions of the stationary part bores and yieldingly urging said tumblers in aligned bores forwardly to positions wherein said interfacial plane is bridged by said follower elements to secure the operating and stationary parts against relative rotation, said driver elements having front ends engageable with a key, whereby rearward movement of the key moves said tumblers in aligned bores rearwardly to positions wherein said joints coincide with said interfacial plane;

and said switch mechanism comprising:

an electrical contact member including integral ring and lead-in elements of conductive material, said lead-in element having a tab portion substantially perpendicular to the plane of said ring element, an insulator including a ring element of insulating material surrounding said shaft adjacent to said stationary part and a boss on the side of the latter ring element and registering with said access slot in the lock cylinder, said insulator ring element having an annular channel-like recess in the surface thereof facing said stationary part and the recess being aligned with said stationary part bores, said boss having a channel-like recess in the outer surface thereof and communicating with said ring element recess, said contact member being seated on said insulator with said contact member ring element received in said recess in said insulator ring element and said contact member tab portion received in said recess in said boss, whereby said contact member is spaced from adjacent components of said lock mechanism and is insulated from the lock mechanism when no tumbler joint is disposed said predetermined distance rearwardly of said interfacial plane, said contact member ring element facing said stationary part bores in alignment therewith for making an electrical contact with the stem portion of the follower element of any of said tumblers which is moved to a position wherein its joint is disposed said predetermined distance rearwardly of said interfacial plane, and means adapted for making electrical connections to said tab portion of the contact member and said follower elements, respectively, whereby they may be connected in an alarm signal circuit closed by making said contact.

5. A combination as defined in claim 4 and wherein said last-named means include a first screw terminal means associated with said tab portion of the contact member, and a second screw terminal means associated with said lock cylinder.

* * * * *